US007591373B2

(12) United States Patent
Horiuchi

(10) Patent No.: US 7,591,373 B2
(45) Date of Patent: Sep. 22, 2009

(54) PACKING STRUCTURE FOR A FLAT PANEL TELEVISION AND METHOD OF PACKING A FLAT PANEL TELEVISION

(75) Inventor: Yasuo Horiuchi, Osaka (JP)

(73) Assignee: Funai Electric Co., Ltd., Daito-shi, Osaka (JP)

( * ) Notice: Subject to any disclaimer, the term of this patent is extended or adjusted under 35 U.S.C. 154(b) by 98 days.

(21) Appl. No.: 11/901,391

(22) Filed: Sep. 17, 2007

(65) Prior Publication Data

US 2008/0173555 A1 Jul. 24, 2008

(30) Foreign Application Priority Data

Sep. 19, 2006 (JP) ..... 2006-252698

(51) Int. Cl.
*B65D 69/00* (2006.01)
*B65B 35/30* (2006.01)

(52) U.S. Cl. ..... 206/576; 206/320; 206/523; 206/586; 53/445

(58) Field of Classification Search ..... 206/320, 206/453, 521, 523, 576, 586, 587, 591, 592, 206/594; 53/443, 445, 458, 468, 474
See application file for complete search history.

(56) References Cited

U.S. PATENT DOCUMENTS 5,823,352 A * 10/1998 Mena et al. ..... 206/586
6,268,039 B1 * 7/2001 Chou et al. ..... 206/586
7,296,680 B2 * 11/2007 Yokawa ..... 206/521
7,299,926 B2 * 11/2007 Russell et al. ..... 206/583

FOREIGN PATENT DOCUMENTS

| | | | |
|---|---|---|---|
| JP | H06-067374 | U | 9/1994 |
| JP | 2002-240859 | | 8/2002 |
| JP | 2002-240859 | A | 8/2002 |
| JP | 2005-104479 | | 4/2005 |
| JP | 2002-302189 | A | 11/2005 |
| JP | 2005-313942 | A | 11/2005 |

OTHER PUBLICATIONS

The extended European search report, pursuant to Rule 62 EPC dated Jan. 22, 2008, searched on Jan. 10, 2008.
Japanese Notice of the reason for refusal, dated Jul. 23, 2008.

* cited by examiner

*Primary Examiner*—Luan K Bui
(74) *Attorney, Agent, or Firm*—Yokoi & Co., U.S.A., Inc.; Peter Ganjian

(57) ABSTRACT

An accessory fixing member 15 to which accessories are fixed is arranged between the rear face of a flat panel television 100 and the inner wall of a packing box 11 when the flat panel television 100 is engaged with top reinforcing members 12 and 13 and a bottom reinforcing member 14 to be housed in the packing box 11. The accessory fixing member is formed such that the upper side of a strap cardboard is folded to U shape in cross section. The upper side of the accessory fixing member 11 supports a load of other packing boxes 11 piled on the upper face of the packing box 11.

7 Claims, 6 Drawing Sheets

PACKING STRUCTURE FOR A FLAT PANEL TELEVISION AND METHOD OF PACKING A FLAT PANEL TELEVISION

CROSS-REFERENCES TO RELATED APPLICATIONS

The present application is related to the Japanese Patent Application No. 2006-252698, filed Sep. 19, 2006, the entire disclosure of which is expressly incorporated by reference herein.

BACKGROUND OF THE INVENTION

1. Field of the Invention

The present invention relates to a packing structure of a flat panel television and a method of packing a flat panel television, and particularly relates to a packing structure of a flat panel television and a method of packing a flat panel television of preventing the flat panel television from damaging during transportation.

2. Description of the Related Art

Hitherto, there have been known the following methods of packing a plasma and a flat panel television. FIG. 6 is a perspective view illustrating a packed flat panel television. As illustrate in the figure, a flat panel television is packed using a packing box 1 housing a flat panel television, styrene-foam top reinforcing members 2 and 3 for fixing the flat panel television inside the packing box 1 when the flat panel television is housed in the packing box and being engaged with the top of the flat panel television to protect the flat panel television in the packing box and a bottom reinforcing member 4 for fixing and protecting the flat panel television widthwise when the flat panel television is housed in the packing box with the bottom thereof fixed to the bottom reinforcing member. Housing the flat panel television in the packing box with use of the above constituents protects the top and bottom thereof with the top reinforcing members 2 and 3 and the bottom reinforcing member 4.

The purpose of packing the flat panel television by the above packing method is to prevent the flat panel television being a commercial product from being damaged during transportation from factories to stores. The flat panel television is assembled in a factory, packed into the packing box 1 and transported to stores with a plurality of the flat panel televisions stacked on pallets. However, the flat panel television is thin and the packing box is also thin according to the thickness of the flat panel television. For this reason, the top subjected to the load of the stacked packing boxes 1 is inevitably small, which may crush the packing box due to the load. This results in damage to the flat panel television housed in the packing box due to load.

There has been disclosed a method of housing a flat panel television in a packing box with the sides thereof interposed and supported between a first and a second packing member and the back face thereof supported with a third packing member to protect the flat panel television from being crushed due to load during transportation. This enables reinforcing the top for supporting a load by the packing members for supporting the sides and back face of the flat panel television (refer to Japanese Unexamined Patent Application Publication (JP-A) No. 2005-104479, for example).

In order to prevent the flat panel television from being damaged inside the packing box due to an adaptor with a protrusion, there has been disclosed a method of fixing and arranging the adaptor between the top of the flat panel television in the packing box and the lid of the packing box to regulate the horizontal move (refer to Japanese Unexamined Patent Application Publication (JP-A) No. 2002-240859, for example).

BRIEF SUMMARY OF THE INVENTION

The invention of Japanese Unexamined Patent Application Publication (JP-A) No. 2005-104479 has the following problem. That is to say, the flat panel television is housed in the packing box with the packing member fixed to the panel television, causing a problem in that a space is not created for housing accessories packed along with the flat panel television. This requires another space to house the accessories to increase the size of the packing box. Recent flat panel televisions have various functions, so that their instruction manuals for describing functions have become further thicker. The functions have been increased, on the other hand, there have been demands among users for a simple operation eliminating useless functions. For this reason, a flat panel television appears which has both a remote control device for capable of operating all functions of the flat panel television and a simple remote controller capable of operating minimum functions thereof as accessories. Thus, the ratio of a space for housing the accessories in the packing box has increased. As described in Japanese Unexamined Patent Application Publication (JP-A) No. 2005-104479, reinforcing the flat panel television with use of the packing members decreases a space between the packing box and the flat panel television not to leave a space for housing the accessories.

Japanese Unexamined Patent Application Publication (JP-A) No. 2002-240859 has the following problem. The flat panel television can be prevented from being damaged inside the packing box, but not due to impact from outside. Therefore, the flat panel television cannot be prevented from being damaged during transportation of the packed flat panel televisions, which is a problem to be solved in the present invention.

The present invention has been made in view of the above, and has for its purpose to provide a method of housing accessories such as instruction manuals and a remote controller without changing the size of the packing box and not damaging the flat panel television housed inside due to the move during transportation and the packing structure of the flat panel television using the above method.

The present invention discloses a packing structure for a flat panel television, comprising: a packing box that is substantially configured as a rectangular parallelepiped and has a rectangular upper face smaller in depth than width and length of the packing box and an opening for housing the flat panel television at the upper face; a top reinforcing member that has a concave engaged with a top of the flat panel television; a bottom reinforcing member that has a concave engaged with a bottom of the flat panel television, the packing structure housing the flat panel television through an opening of the packing box with the flat panel television engaged with the top reinforcing members and the bottom reinforcing member; the packing box has an accessory fixing member that is U shaped so that both ends of a strap member are folded so that the width of the strap member is substantially equal to a width of the packing box; the accessory fixing member that has an accessory fixing face to which accessories of the flat panel television are fixed; the accessory fixing face is a side of bending direction in which ends of the strap member are folded; the flat panel television is housed through the opening of the packing box and then the accessory fixing member is arranged and housed in a space created between the packing box and a rear face side of the flat panel television with the accessory fixing member maintained in U shape.

In the packing structure of the flat panel television configured as the above, the accessory fixing member is formed such that both end faces of a belt-like member are folded in U shape and the accessories are fixed in the direction in which the accessory fixing face is folded. The accessory fixing member is arranged between the flat panel television in the packing box and the inner wall of the packing box such that the accessory fixing face to which the accessories are fixed oppose the rear face of the flat panel television. At this point, the both end faces folded in U shape are housed in a space between the inner side of the side wall of the packing box and the side of the flat panel television to maintain the U shape of the accessory fixing member. This reinforces the upper face of the packing box by the top reinforcing members and the accessory fixing member. Even when packing boxes housing other flat panel televisions are piled on the upper face, the packing box is prevented from being crushed.

A place where the accessory fixing member is arranged in the packing box is not limited to the rear side of the flat panel television to be housed. For this reason, an optional aspect of the present invention provides the accessory fixing member is arranged and housed in the space created between the packing box and a front face side of the flat panel television with the face of the accessory fixing member to which the accessories are fixed caused to oppose a display panel side of the flat panel television and with the accessory fixing member maintained in U shape.

In the packing structure of the flat panel television configured as the above, the accessory fixing member is arranged on the display panel side of the flat panel television. This permits effectively using a space in the packing box. In addition, the accessory fixing member may be arranged only on the display panel side or on both of the display panel side and rear side of the flat panel television.

An optional aspect of the present invention provides the accessory fixing member is formed of a corrugated cardboard not subjected to surface treatment.

In the packing structure of the flat panel television configured as the above, the accessory fixing member is housed inside, different from the packing box, so that the accessory fixing member does not need to be subjected to surface treatment. Consequently, the accessory fixing member is formed using a corrugated cardboard not subjected to surface treatment to enable the production cost to be suppressed.

An optional aspect of the present invention provides the accessory fixing member includes accessory fixing pieces for fixing the accessories that are formed two cuts are made in the upper and the lower side of the accessory fixing face at predetermined spaced intervals, and the inner face sides of the cuts are folded in the same direction as both sides to form fixing pieces, and the accessories are fixed by a tape to a position where the upper and the lower side of the accessories are surrounded by the fixing pieces of the accessory fixing member.

In the packing structure of the flat panel television configured as the above, the accessory fixing pieces folded in the direction in which both ends are folded are formed at the upper and the lower side of the accessory fixing member. The upper and the lower side of the accessories are surrounded by the fixing pieces and fixed to the accessory fixing face by a tape. This does not cause the accessories to move inside during transportation, which allows preventing the packed flat panel television from being damaged.

An optional aspect of the present invention provides the fixing pieces of the accessory fixing member have protruding pieces that is extended over a predetermined length and are the same in thickness of the fixing pieces.

In the invention configured as the above, when an impact is applied to a side with the flat panel television and the accessory fixing member packed in the packing box, the protruding pieces formed at the tip of the accessory fixing pieces abut on the flat panel television and are deformed and crushed to absorb the impact to be applied. This protects the packed flat panel television against damage.

An optional aspect of the present invention provides the top reinforcing member includes first and second members engaged with upper right corner and upper left corner of the flat panel television, respectively, the accessory fixing member is formed so that the width of the accessory fixing face can be housed between the first and the second member engaged with the flat panel television, and the accessory fixing member is arranged and housed in the space between the first member and the second member.

In the invention configured as the above, the top reinforcing members are engaged with both top ends of the flat panel television. For this reason, a space is created around the center of the flat panel television between the first and the second member. The accessory fixing member is arranged between the first and the second member. Accordingly, the accessory fixing member is reduced widthwise to decrease materials for forming, enabling waste of resources to be avoided.

One aspect of the present invention provides a packing structure for a flat panel television, comprising: a packing box that is substantially configured as a rectangular parallelepiped and has a substantially rectangular upper face smaller in depth than width and length of the packing box and an opening for housing the flat panel television at the rectangular upper face; a top reinforcing member that is substantially configured as a rectangular parallelepiped and is formed of styrene foam and that includes a first member and a second member having concaves engaged with a top of the flat panel television; a bottom reinforcing member that is substantially configured as a rectangular parallelepiped and is formed of styrene foam and that having a concave engaged with a bottom of the flat panel television; the packing structure housing the flat panel television through the opening of the packing box with the flat panel television engaged with the top reinforcing members and the bottom reinforcing member; a U shaped accessory fixing member that is a strap corrugated cardboard not subjected to surface treatment and both ends of the strap corrugated cardboard are folded so that the length of the corrugated cardboard is substantially equal to the width of the packing box; the U-shaped accessory fixing member includes an accessory fixing face to which accessories of the flat panel television are fixed by a tape in the direction in which both ends of strap corrugated cardboard are folded;

the accessory fixing member includes accessory fixing pieces that are formed two cuts are made perpendicularly to the upper and the lower side of the accessory fixing face at predetermined spaced intervals, and an inner face sides of the cuts are folded in a same direction as both ends of strap corrugated cardboard, and the flat panel television having top and bottom that are engaged with the top and the bottom reinforcing member respectively is housed through the opening, the accessories are fixed between the fixing pieces on the upper and the lower side of the accessory fixing face and then the accessory fixing member is housed in a space surrounded with the packing box, a rear face of the flat panel television, the first member of the top reinforcing member and the second member of the top reinforcing member with a face to which the accessories are fixed caused to oppose the rear face of the flat panel television and with the accessory fixing member maintained in U shape.

One aspect of the present invention provides a method of packing a flat panel television wherein the flat panel television is housed and packed in a packing box that is substantially configured as a rectangular parallelepiped and has a rectangular upper face smaller in depth than width and length of the packing box and an opening for housing the flat panel television at an upper face of the packing box, the method comprising: engaging a concave portion of a top reinforcing member with a top of the flat panel television, engaging a concave portion of a bottom reinforcing member with a bottom of the flat panel television, and housing the flat panel television through the opening of the packing box, and housing an accessory fixing member in a space created between the packing box and a rear face side of the flat panel television with the accessory fixing member maintained in U shape, the accessory fixing member formed in U shape so that both ends of a strap member are folded so that the width of the strap member is substantially equal to a width of the packing box and in which an accessory fixing face to which accessories of the flat panel television are fixed, and the accessory fixing face is a side of bending direction in which ends of the strap member are folded.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character(s) present corresponding parts throughout.

DETAILED DESCRIPTION OF THE INVENTION

Figure 1:
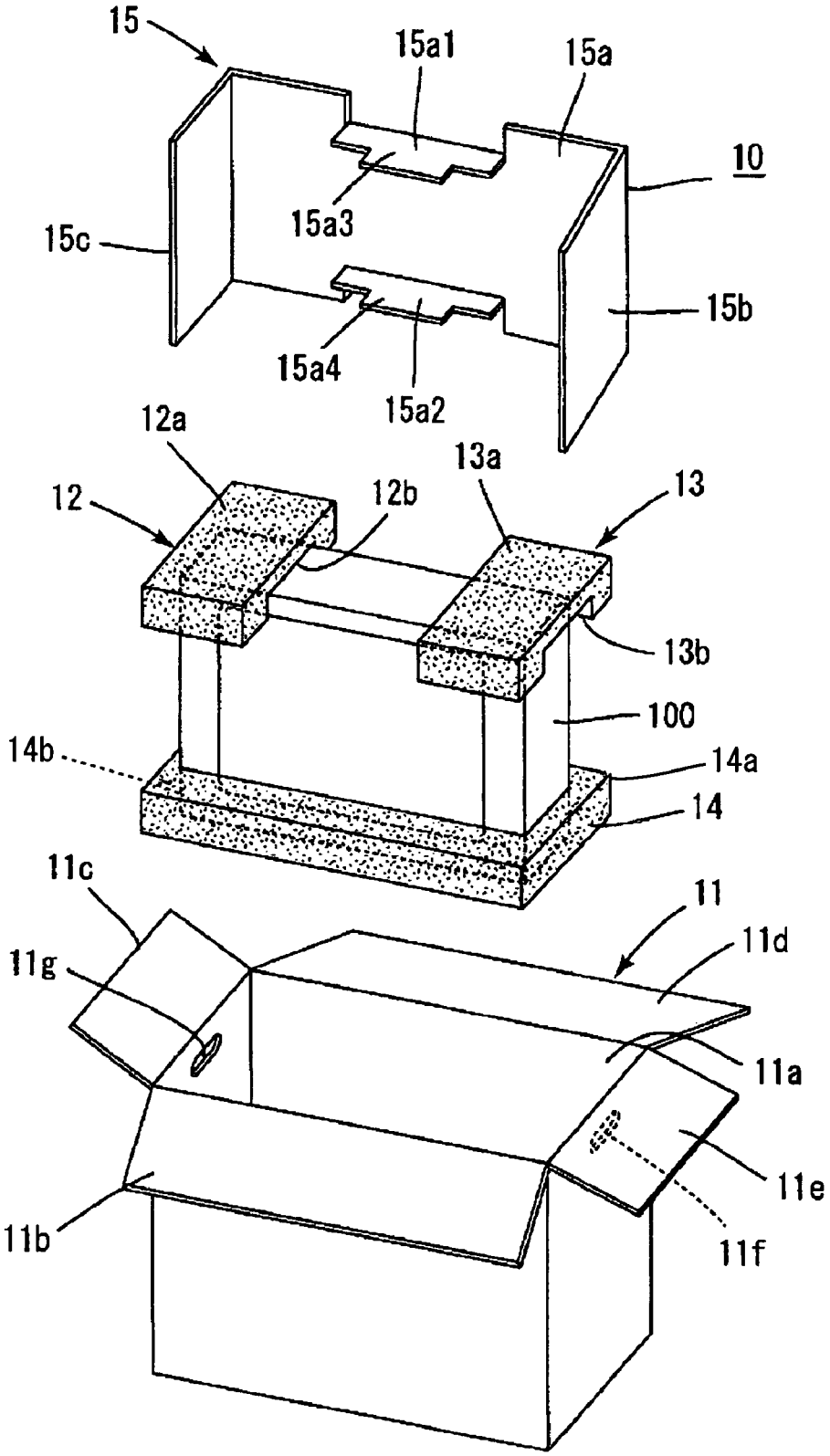
FIG. 1 is a developed view illustrating a packing structure of the flat panel television.

The detailed description set forth below in connection with the appended drawings is intended as a description of presently preferred embodiments of the invention and is not intended to represent the only forms in which the present invention may be constructed and or utilized.

For purposes of illustration, programs and other executable program components are illustrated herein as discrete blocks, although it is recognized that such programs and components may reside at various times in different storage components, and are executed by the data processor(s) of the computers.

A packing structure of a flat panel television according to the present invention is described in detail in the following order.

(1) A first embodiment
(2) Roundup of the first embodiment
(3) A second embodiment
(4) Roundup of the second embodiment
(5) A third embodiment
(6) Roundup of the third embodiment

(1) A First Embodiment

A first embodiment of the present invention is described with reference to FIGS. 1 to 3. FIG. 1 is a developed view illustrating a packing structure of the flat panel television according to the first embodiment of the present invention. As illustrated in the figure, the packing structure of the flat panel television 10 includes a packing box 11 housing a flat panel television 100, top reinforcing members 12 and 13 engaged with the top of the flat panel television 100, a bottom reinforcing member 14 engaged with the bottom of the flat panel television 100 and an accessory fixing member 15 for fixing accessories such as remote controller and reinforcing the packing box 11. According to the above configuration, the packing structure 10 of the flat panel television is such that the flat panel television 100 is housed in the packing box 11 with the top reinforcing members 12 and 13 engaged with the top of the flat panel television 100 and with the bottom reinforcing member 14 engaged with the bottom thereof. Then, the accessory fixing member 15 is housed in the packing box 11 with accessories fixed to the accessory fixing member 15. The following is a detailed description in due order.

The packing box 11 serves to house the flat panel television 100 and the accessories 101 to prevent the flat panel television from being damaged during transportation. The packing box 11 is made of a thick paper such as a cardboard, box shaped and has a rectangular upper face smaller in depth according to the shape of the flat panel television 100 and an opening at the upper face for housing the flat panel television. The packing box 11 has an opening portion 11*a* for housing the flat panel television 100 at the upper face of the packing box 11 and the flat panel television 100 is housed in the packing box 11 from the opening portion 11*a*. Furthermore, the packing box 11 has extending lids 11*b*, 11*c*, 11*d* and 11*e* which are the same in thickness around the periphery of the opening portion 11*a*. The flat panel television 100 is housed through the opening portion 11*a* and then the lids 11*b*, 11*c*, 11*d* and 11*e* are folded along the periphery of the opening portion 11*a* toward the center of the opening portion 11*a*. After that, the lids 11*b*, 11*c*, 11*d* and 11*e* are fixed by adhesive cloth such as a tape to pack the flat panel television 100. In addition, the packing box 11 has carrying holes 11*f* and 11*g* on the sides thereof for facilitating carrying of the packing box 11 by hand. This enables the packing box 11 to be carried with hand inserted into the carrying holes 11*f* and 11*g* after the flat panel television 100 is packed.

Although the packing box 11 according to the present invention is integrally formed of a cardboard, the packing box 11 is not limited to this form. The flat panel television may be packed in a bottom packing-box and then a top packing-box may cover the bottom packing-box. The number of the lids 11*b*, 11*c*, 11*d* and 11*e* and the position of the opening portion 11*a* may be determined at discretion and these are design matters.

The top reinforcing members 12 and 13 and the bottom reinforcing member 14 are engaged with the flat panel television 100 and housed in the packing box 11 thereby to protect the flat panel television. The top reinforcing members 12 and 13 are formed of styrene foam and have concaves 12*b* and 13*b* engaged with the periphery of top of the flat panel television at the substantial center of main body portions 12*a*and 13*a* which are in a rectangular box shape in cross section.

*Trenches are formed in the concaves* 12*b* and 13*b* perpendicularly to the longitudinal sides of the main body portions 12*a* and 13*a*, so that the longitudinal sides of the main body portions 12*a* and 13*a* is substantially perpendicular to the display panel face of the flat panel television 100 when the top of the flat panel television 100 is inserted into and engaged with the trenches. The length of the longitudinal sides of the main body portions 12*a* and 13*a* is equal to the width of the packing box 11. For this reason, the top periphery of the flat panel television 100 is inserted from above into and engaged with the concaves 12*b* and 13*b* to cause the front and the rear surface of the main body portions 12*a* and 13*a* of the top reinforcing members 12 and 13 to abut on the inner wall of the packing box 11 in the thickness direction thereof.

The bottom reinforcing member 14 is formed of styrene foam and has a concave 14*b* engaged with the bottom of the flat panel television 100 or the bottom of a leg. The bottom reinforcing member 14 is rectangular and larger than the circumference of the flat panel television 100 in cross section and the concave 14*b* engaged with the bottom of the flat panel television 100 or the bottom of the leg is formed at the substantial center of the top of the main body 14*a* which is almost the same in size as the bottom of the packing box 11. The bottom reinforcing member 14 is engaged with the flat panel television 100 such that the circumferences of the flat panel television 100 seen in cross section (or the cross section of a panel) are approximately parallel to the circumference of the main body 14*a*. According to the structure of the bottom reinforcing member 14, the bottom of the flat panel television 100 or the bottom of the leg is inserted into the concave 14*b* and the packing box 11 to cause the circumference of the bottom reinforcing member 14 in cross section to abut on the inner wall of the packing box 11.

The top reinforcing members 12 and 13 and the bottom reinforcing member 14 engaged with the flat panel television 100 and are inserted into the packing box 11 to cause the circumferences of the top reinforcing members 12 and 13 and the bottom reinforcing member 14 to abut on the circumference of the inner wall of the packing box 11 thereby to fix the flat panel television 100 at a predetermined position of the packing box 11. At this point, the circumferences of the top reinforcing members 12 and 13 and the bottom reinforcing member 14 are larger than those of the flat panel television 100 and the circumferences of the reinforcing members abut on the inner wall side of the packing box 11, creating a space between the housed flat panel television 100 and the inner side of the packing box 11. Specifically, the space is created on the display panel and the rear side of the flat panel television 100 at a position which is between the bottom reinforcing member 14 and the top reinforcing members 12 and 13 in height. For this reason, in the present invention, the accessory fixing member 15 is used to arrange and house the accessories in the space.

The accessory fixing member 15 is described below. FIG. 2 is a perspective view illustrating the accessory fixing member. The accessory fixing member 15 serves to arrange and house remote controllers and an instruction manual at a predetermined position in the packing box 11. Accessories 101 according to the embodiment of the present invention include an instruction manual 101*a* describing the functions of the flat panel television 100, a remote controller 101*b* remotely controlling the flat panel television 100 and capable of operating all functions of the flat panel television 100 and a simplified remote controller 101*c* capable operating only the minimum functions of the flat panel television 100. The accessories are not limited to those, but properly changed according to a flat panel television to be used.

Figure 2:
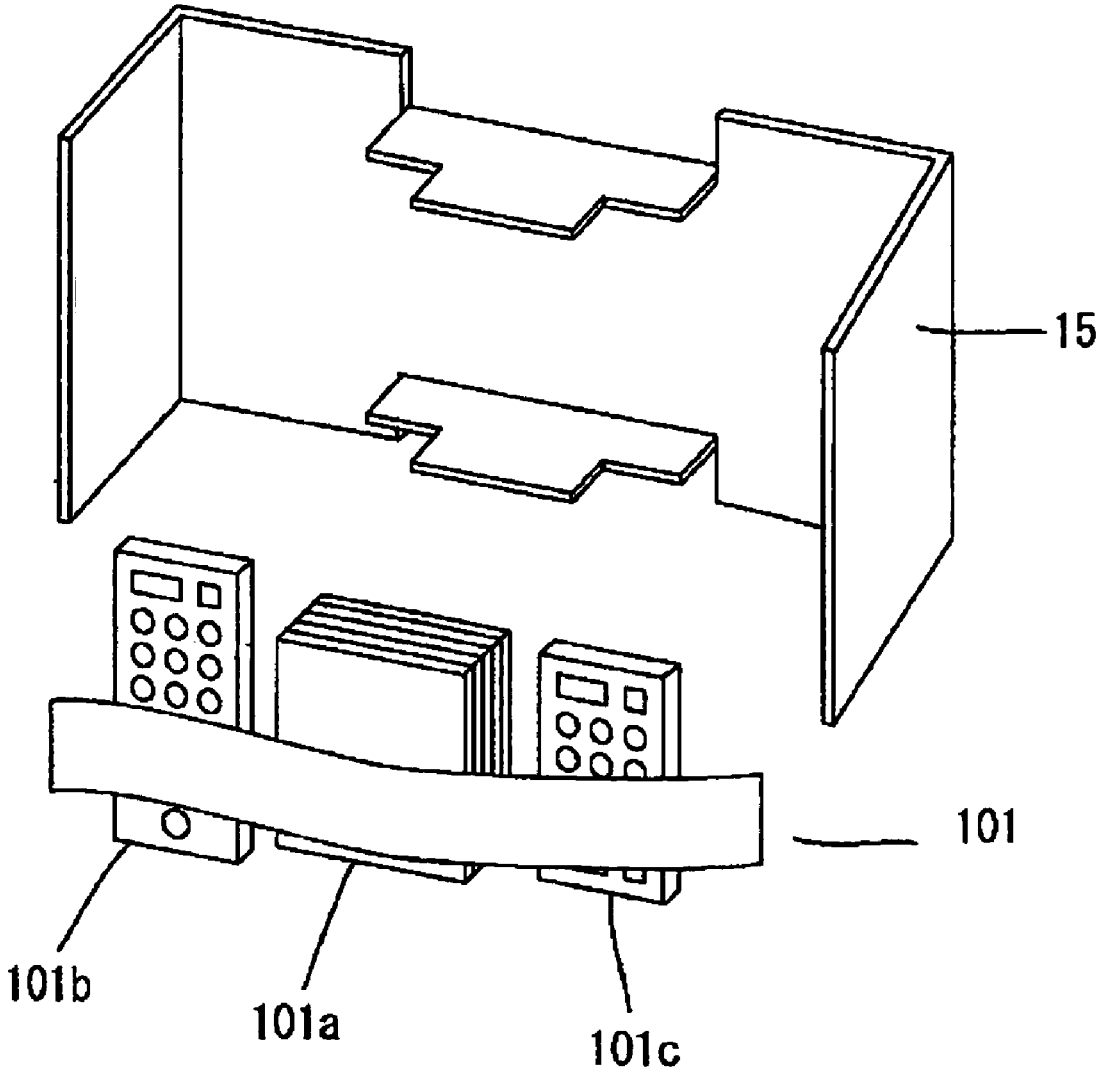
FIG. 2 is a perspective view illustrating a accessory fixing member.
Figure 3:
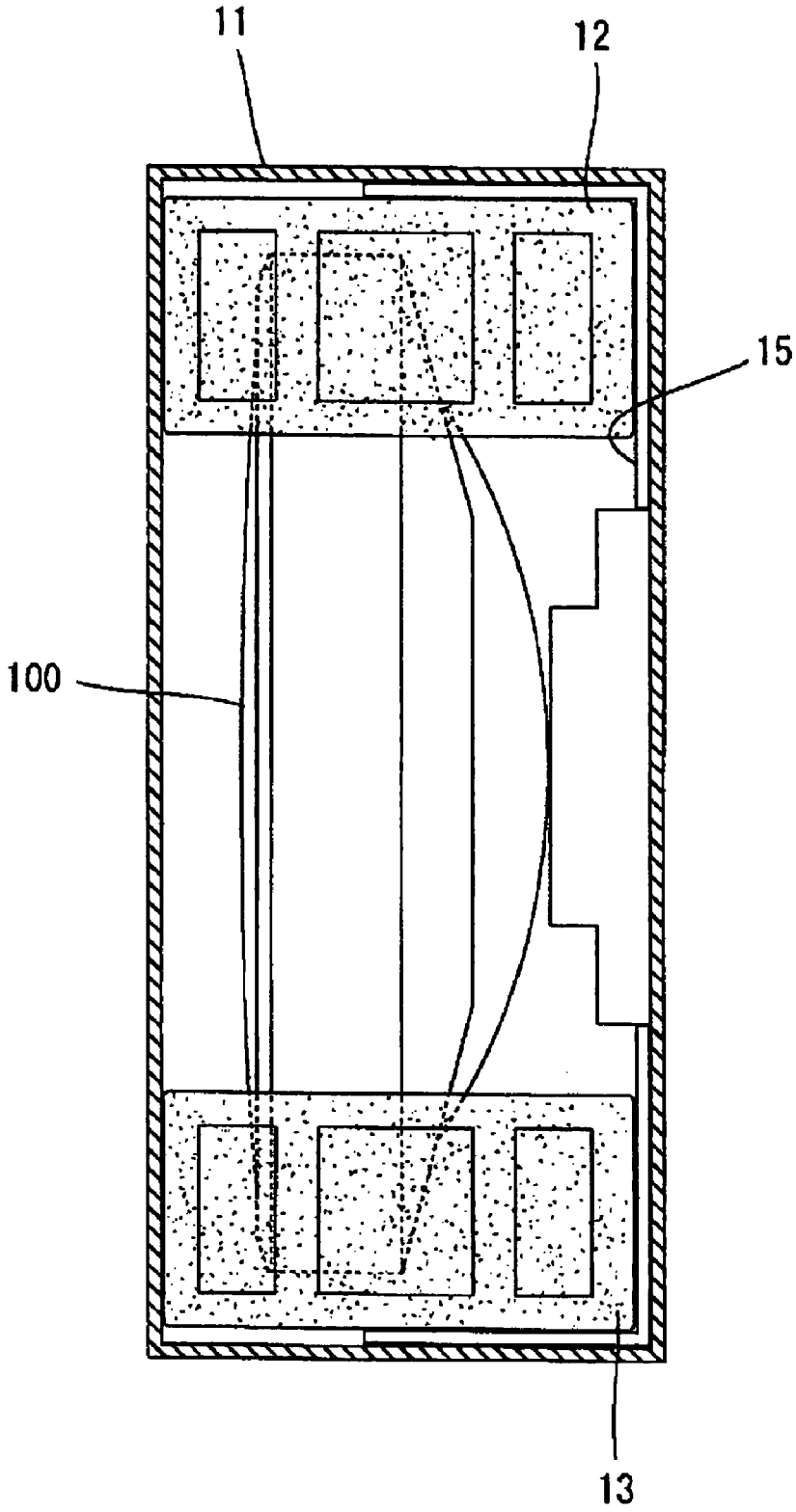
FIG. 3 is a top view illustrating the accessory fixing member housed in a packing box.

As illustrated in FIG. 2, the accessory fixing member 15 is formed in U shape in cross section such that both end faces of corrugated cardboard which is thin, belt-like and not subjected to surface treatment are folded in the same direction. The accessory fixing member 15 includes an accessory fixing face 15*a* being a center face and both end faces 15*b* and 15*c* in which both end faces of the accessory fixing face 15*a* are folded by a predetermined length. Accessory fixing pieces 15*a*1 and 15*a*2 are formed in such a manner that the longitudinal sides of the accessory fixing face 15*a* are taken to be the upper and the lower side, two cuts are made at the substantial center of the upper and the lower side approximately perpendicularly to the upper and the lower side at predetermined spaced intervals and the inner faces of the cuts are folded in the same direction as both end faces 15*b* and 15*c* and raised perpendicularly to the accessory fixing face 15*a*. The accessory fixing pieces 15*a*1 and 15*a*2 are provided with protruding pieces 15*a*3 and 15*a*4 which extend and are the same in thickness. Thus, the remote controllers and the instruction manual being accessories are fixed to and arranged on the accessory fixing face 15*a* where the upper and the lower side of the accessories are surrounded by the fixing pieces 15*a*1 and 15*a*2.

A method of fixing the accessories 101 to the accessory fixing member 15 is described below. The accessories 101 are fixed by a tape to a position where the upper and the lower side of the accessories are surrounded by the fixing pieces 15*a*1 and 15*a*2 of the accessory fixing member 15. This arranges the accessories 101 in the direction in which both end faces 15*b* and 15*c* of the accessory fixing member 15 are folded. The arrangement of the accessories may be properly changed.

The configuration of the accessory fixing member 15 housed in the packing box 11 is described below. FIG. 3 is a top view illustrating the accessory fixing member housed in the packing box. As illustrated in the figure, in the accessory fixing member 15, the accessory fixing face 15*a* is housed between the rear face of the flat panel television 100 and the inner wall of the packing box 11, and both end faces 15*b* and 15*c* are housed between the side faces of the flat panel television 100 and the side faces of the packing box 11. Since the top reinforcing members 12 and 13 are engaged with both top sides of the flat panel television 100, an opening surrounded by the inner wall of the packing box 11 and the side walls of the top reinforcing members 12 and 13 is created at the center periphery of the rear face of the flat panel television 100. For this reason, the accessories 101 fixed to the accessory fixing member 15 are inserted into the opening at the center periphery of the rear face. The bottom side of the accessory fixing member 15 abuts on the bottom reinforcing member 14 and is arranged at a predetermined position in the packing box 11. Thus, the accessories fixed to the accessory fixing member 15 are arranged in the space created between the top reinforcing members 12 and 13 and the bottom reinforcing member 14 and between the rear face of the flat panel television 100 and the inner wall of the packing box 11. The protruding pieces 15*a*3 and 15*a*4 extending toward the rear face of the flat panel television 100 abut on and arranged at the rear face of the flat panel television 100.

(2) Roundup of the First Embodiment

According to the method described above, the upper face of the top reinforcing members 12 and 13 and the upper side of the U shaped accessory fixing member 15 are arranged on the upper face side of the packing box 11 housing the flat panel television 100 and the accessory fixing member 15. For this reason, even when a load (other packing boxes housing the flat panel televisions) is stacked on the upper face of the packing box 11, the load is supported by the top reinforcing members 12 and 13 and the upper side of the U shaped accessory fixing member 15, so that stress is stronger against the load. This allows creating the packing structure of the flat panel television in which the packing box 11 is crush-resistant when piled up. The accessory fixing member 15 is formed of a cardboard not subjected to surface treatment, so that reinforcement can be performed at a lower cost than the case where the packing box 11 in itself is strengthened. Even if a shock is applied to the rear face side of the flat panel television 100 in the packing box 11, the protruding pieces 15*a*3 and 15*a*4 collide with the rear face of the flat panel television 100 to be deformed, thereby decreasing the shock from the rear face side of the flat panel television 100.

(3) A Second Embodiment

A second embodiment of the present invention is described with reference to FIG. 4. In the first embodiment, the accessory fixing member 15 is so arranged as to cover the whole rear face of the flat panel television 100. However, the accessory fixing member 15 may be housed in a space surrounding its periphery with the top reinforcing members 12 and 13, the rear face of the flat panel television 100 and the inner wall of the packing box 11. This produces the same effect as the first embodiment and downsizes the accessory fixing member 15 to enable reducing materials for forming the accessory fixing member 15, eliminating excessive packaging, and avoiding waste of resources.

Figure 4:
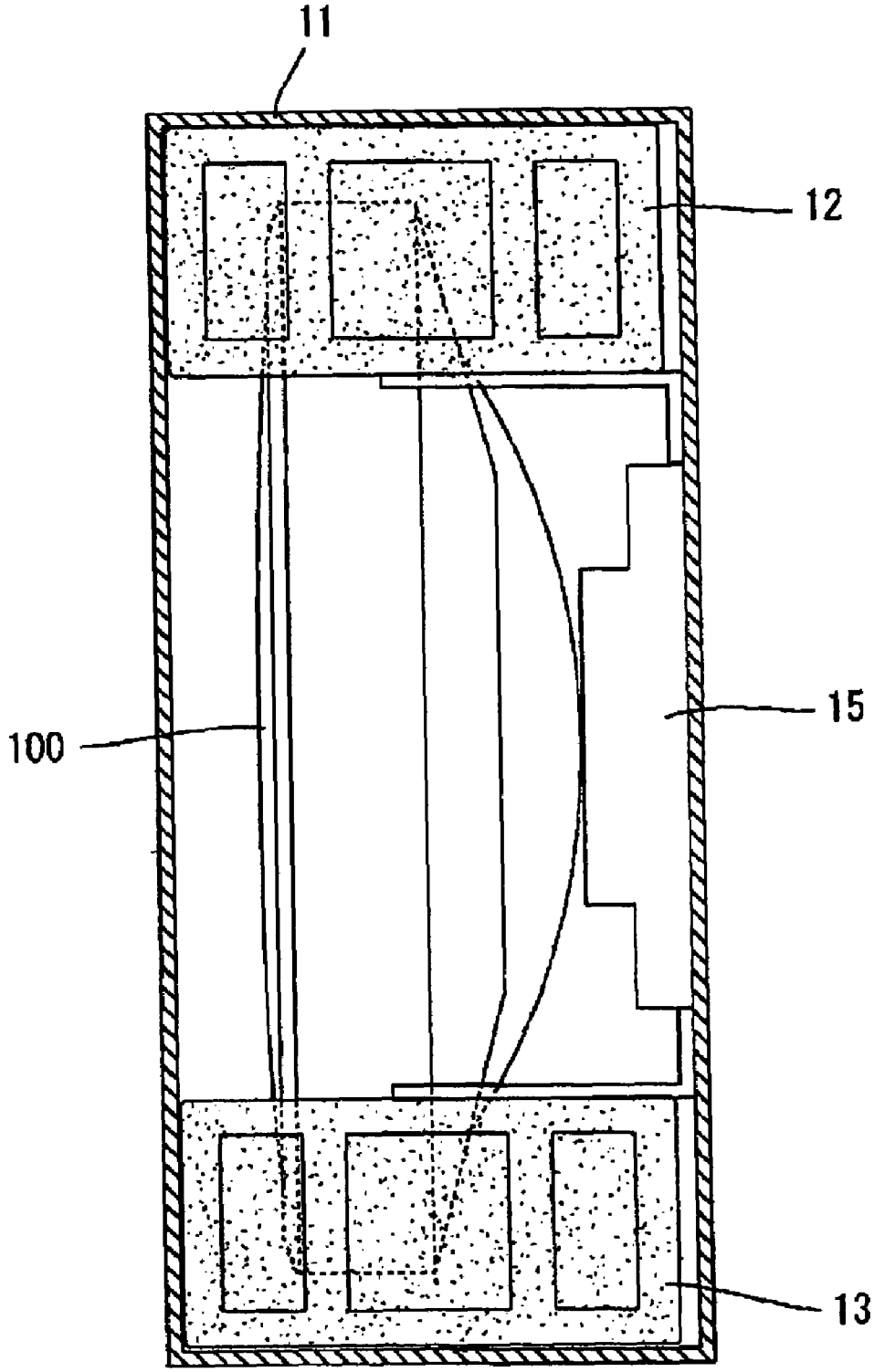
FIG. 4 is a top view illustrating the accessory fixing member housed in the packing box.

FIG. 4 is a top view illustrating the accessory fixing member 15 housed in the packing box 11 according to the second embodiment. As illustrated in the figure, the accessory fixing member 15 is housed in the space surrounding its periphery with the top reinforcing members 12 and 13, the rear face of the flat panel television and the inner wall of the packing box 11. For this reason, the width of the accessory fixing face 15*a* of the accessory fixing member 15 is substantially equal to the length between the top reinforcing members 12 and 13 engaged with the flat panel television 100. The length of both end faces 15*b* and 15*c* is desirably almost equal to the length between the rear face of the flat panel television 100 and the inner face of the packing box 11.

A method of arranging the accessory fixing member 15 having the shape described above in the space created between the top reinforcing members 12 and 13 at the rear face of the aforementioned packing box 11. Specifically, the accessories 101 are fixed to the accessory fixing face 15*a* of the accessory fixing member 15 by a tape and both end faces 15*b* and 15*c* are folded in the direction in which the accessories 101 are fixed. In this state of things, the accessory fixing member 15 is inserted between top reinforcing members 12 and 13 on the rear side of the packing box 11 with the accessory fixing face 15*a* to which the accessories 101 are fixed caused to oppose the rear face of the flat panel television 100. At this point, more preferably, the accessory fixing face 15*a* needs to be at least the same in size as a face to which the accessories 101 are fixed, so that the space between the top reinforcing members 12 and 13 where the accessory fixing face 15*a* is arranged needs to be the same in size as the accessory fixing face 15*a*.

(4) Roundup of the Second Embodiment

As described above, the top reinforcing members 12 and 13 and the upper side of the U shaped accessory fixing member 15 located between the top reinforcing members 12 and 13 are arranged on the upper face side of the packing box 11. For this reason, even when a load is stacked on the upper face, the load applied to the upper face is supported by the top reinforcing members 12 and 13 and the upper side of the accessory fixing member 15. The materials for forming the accessory fixing member 15 can be reduced than those used in the first embodiment to enable avoiding waste of resources.

(5) A Third Embodiment

In the first and the second embodiment, the accessory fixing member 15 is arranged on the rear side of the flat panel television 100 to reinforce the upper face side of the packing box 11. However, two accessory fixing members 15 may be arranged on both the display panel side and the rear face side of the flat panel television 100. This permits a space of the packing box 11 to be effectively used because the space created on the display panel side and the rear face side of the flat panel television 100 is used, reinforcing the upper face side of the packing box 11 against a load and preventing crush due to a pile of the packing boxes 11.

Figure 5:
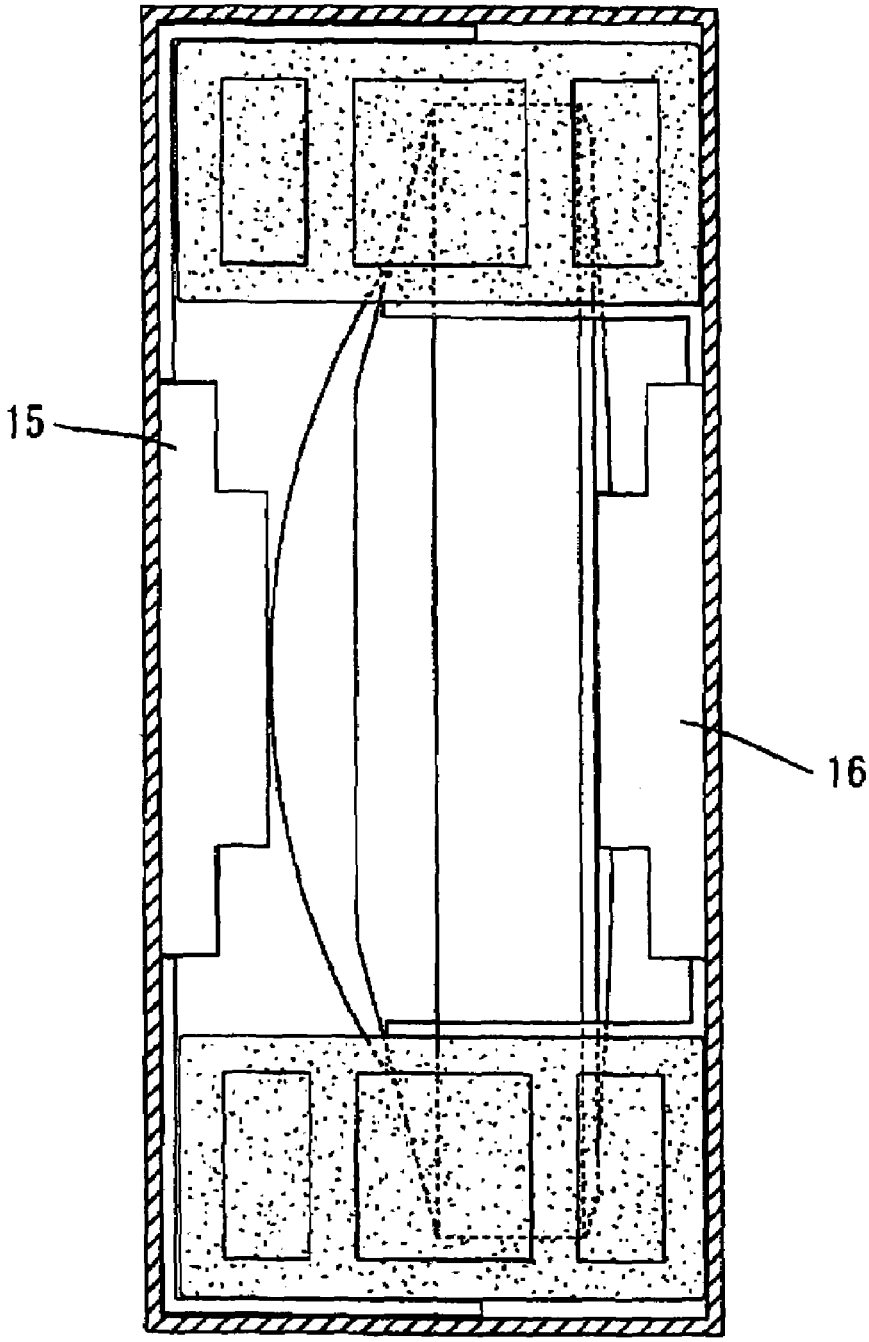
FIG. 5 is a top view illustrating the accessory fixing member housed in the packing box.
Figure 6:
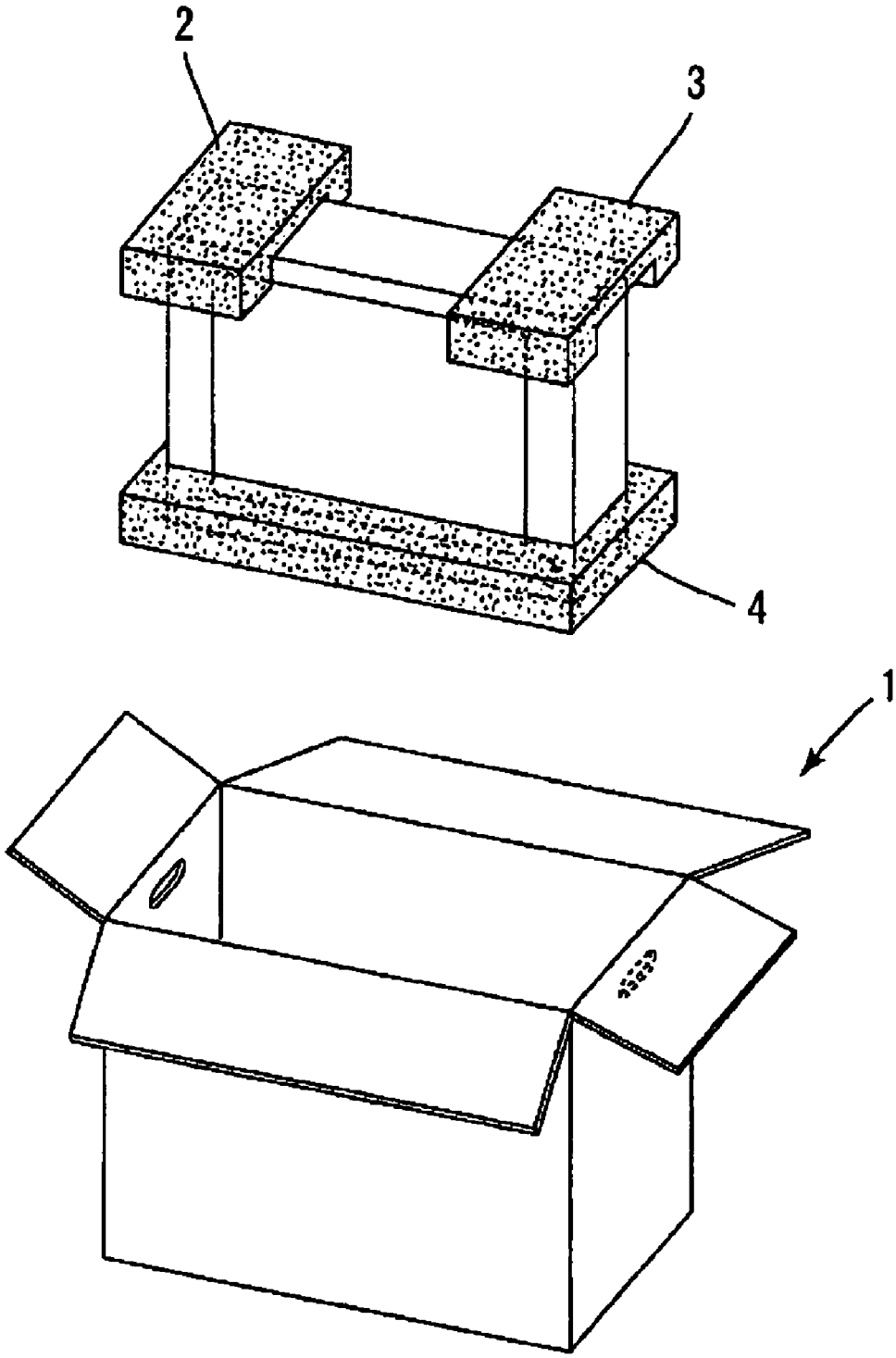
FIG.6 Prior Art
FIG. 6 is a perspective view illustrating a packed flat panel television according to a related art.

FIG. 5 is a top view illustrating the accessory fixing members 15 and 16 housed in the packing box according to the third embodiment. The accessory fixing members 15 and 16 used in the third embodiment are the same in shape as the accessory fixing member 15 described in the first embodiment, so that the description thereof is omitted herein. As illustrated in the figure, the accessory fixing members 15 and 16 are arranged on both the display panel side and the rear face side of the flat panel television 100 with the accessory fixing faces to which the accessories are fixed caused to oppose each other. This arranges the upper faces of the reinforcing members 12 and 13 and the upper sides of the U shaped accessory fixing members 15 and 16 on the top face side of the packing box 11.

(6) Roundup of the Third Embodiment

According to the third embodiment, the packing box 11 houses the flat panel television 100 therein with the accessory fixing members 15 and 16 arranged on the front and the rear side of the flat panel television 100, so that the top reinforcing members 12 and 13 and the upper sides of the U shaped accessory fixing members 15 and 16 support the weight of other packing boxes piled on the upper face of the packing box 11. For this reason, the upper face of the packing box enables supporting a heavier load. Furthermore, the accessory fixing members 15 and 16 are used to allow the accessories to be housed in the space created between the packing box 11 and the housed flat panel television 100, permitting more efficiently using the packing box 11.

It is to be understood that the present invention is not limited to the above embodiments. It is further to be understood by those skilled in the art that the following are disclosed as one embodiment of the present invention:

members and configurations replaceable with each other disclosed in the above embodiments may be properly changed in combination and applied;

members and configurations which are not disclosed in the above embodiments but a known art and replaceable with the members and configurations disclosed in the above embodiments may be properly changed in combination and applied; and members and configurations which are not disclosed in the above embodiments may be properly replaced with members and configurations presumed by those skilled in the art based on known art to be substitutes for the members and configurations disclosed in the above embodiments or may be properly changed in combination.

In addition, reference to "first," "second," "third," and etc. members throughout the disclosure (and in particular, claims) is not used to show a serial or numerical limitation but instead is used to distinguish or identify the various members of the group.

What is claimed is:

1. A packing structure for a flat panel television, comprising:

a packing box that is substantially configured as a rectangular parallelepiped and has a substantially rectangular upper face smaller in depth than width and length of the packing box and an opening for housing the fiat panel television at the rectangular upper face;

a top reinforcing member that is substantially configured as a rectangular parallelepiped and is formed of styrene foam and that includes a first member and a second member having concaves engaged with a top of the flat panel television;

a bottom reinforcing member that is substantially configured as a rectangular parallelepiped and is formed of styrene foam and that having a concave engaged with a bottom of the flat panel television;

the packing structure housing the flat panel television through the opening of the packing box with the flat panel television engaged with the top reinforcing member and the bottom reinforcing member;

a U shaped accessory fixing member that is a strap corrugated cardboard not subjected to surface treatment and both ends of the strap corrugated cardboard are folded so that the length of the corrugated cardboard is substantially equal to the width of the packing box;

the U-shaped accessory fixing member includes an accessory fixing face to which accessories of the flat panel television are fixed by a tape in the direction in which both ends of strap corrugated cardboard are folded;

the accessory fixing member includes accessory fixing pieces that are formed two cuts are made perpendicularly to the upper and the lower side of the accessory fixing face at predetermined spaced intervals, and an inner face sides of the cuts are folded in a same direction as both ends of strap corrugated cardboard, and the flat panel television having top and bottom that are engaged with the top and the bottom reinforcing member respectively is housed through the opening, the accessories are fixed between the fixing pieces on the upper and the lower side of the accessory fixing face and then the accessory fixing member is housed in a space surrounded with the packing box, a rear face of the flat panel television, the first member of the top reinforcing member and the second member of the top reinforcing member with a face to which the accessories are fixed caused to oppose the rear face of the flat panel television and with the accessory fixing member maintained in U shape.

2. A packing structure for a flat panel television, comprising:

a packing box that is substantially configured as a rectangular parallelepiped and has a rectangular upper face smaller in depth than width and length of the packing box and an opening for housing the flat panel television at the upper face;

a top reinforcing member that has a concave engaged with a top of the flat panel television;

a bottom reinforcing member that has a concave engaged with a bottom of the flat panel television;

the packing structure housing the flat panel television through the opening of the packing box with the flat panel television engaged with the top reinforcing member and the bottom reinforcing member;

the packing box has an accessory fixing member that is U shaped so that both ends of a strap member are folded so that the width of the strap member is substantially equal to a width of the packing box;

the accessory fixing member that has an accessory fixing face to which accessories of the fiat panel television are fixed;

the accessory fixing face is a side of bending direction in which ends of the strap member are folded;

the flat panel television is housed through the opening of the packing box and then the accessory fixing member is arranged and housed in a space created between the packing box and a rear face side or the packing box and a front face side of the flat panel television with the accessory fixing member maintained in U shape.

3. The packing structure according to claim 2, wherein the accessory fixing member is formed of a corrugated cardboard not subjected to surface treatment.

4. The packing structure according to claim 2, wherein the accessory fixing member includes accessory fixing pieces for fixing the accessories that are formed two cuts are made in the upper and the lower side of the accessory fixing face at predetermined spaced intervals, and the inner face sides of the cuts are folded in the same direction as both sides to form fixing pieces, and the accessories are fixed by a tape to a position where the upper and the lower side of the accessories are surrounded by the fixing pieces of the accessory fixing member.

5. The packing structure according to claim 4, wherein the fixing pieces of the accessory fixing member have protruding pieces that is extended over a predetermined length and are the same in thickness of the fixing pieces.

6. The packing structure according to claim 2, wherein the top reinforcing member includes first and second members engaged with upper right corner and upper left corner of the flat panel television, respectively, the accessory fixing member is formed so that the width of the accessory fixing face can be housed between the first and the second member engaged with the flat panel television, and the accessory fixing member is arranged and housed in the space between the first member and the second member.

7. A method of packing a flat panel television wherein the flat panel television is housed and packed in a packing box that is substantially configured as a rectangular parallelepiped and has a rectangular upper face smaller in depth than width and length of the packing box and an opening for housing the flat panel television at an upper face of the packing box. the method comprising:

engaging a concave portion of a top reinforcing member with a top of the flat panel television, engaging a concave portion of a bottom reinforcing member with a bottom of the flat panel television, and housing the flat panel television through the opening of the packing box, and housing an accessory fixing member in a space created between the packing box and a rear face side of the flat panel television with the accessory fixing member maintained in U shape, the accessory fixing member formed in U shape so that both ends of a strap member are folded so that the width of the strap member is substantially equal to a width of the packing box and in which an accessory fixing face to which accessories of the flat panel television are fixed, and the accessory fixing face is a side of bending direction in which ends of the strap member are folded.

* * * * *